United States Patent [19]

Maire

[11] 4,303,215

[45] Dec. 1, 1981

[54] DEVICE FOR CONTROLLING THE STOPPING OF A TRAIN

[76] Inventor: Alaine Maire, 4, Impasse de Toulouse, Versailles (Les Yvelines), France

[21] Appl. No.: 61,647

[22] Filed: Jul. 30, 1979

[51] Int. Cl.[3] ..... B61L 3/24

[52] U.S. Cl. ..... 246/182 B; 246/187 B; 246/187 C

[58] Field of Search ..... 246/187 C, 182 B, 187 B, 246/187 A, 167 R, 63 R, 63 C

[56] References Cited

U.S. PATENT DOCUMENTS

| | | | |
|---|---|---|---|
| 3,029,893 | 4/1962 | Mountjoy | 246/63 R X |
| 3,353,019 | 11/1967 | Allen | 246/63 R X |
| 3,363,096 | 1/1968 | Hughson et al. | 246/182 B |
| 3,524,055 | 8/1970 | Smith | 246/182 B X |
| 3,828,225 | 8/1974 | Grundy | 246/182 B X |
| 3,974,992 | 8/1976 | Matty | 246/182 B |
| 3,991,958 | 11/1976 | Sibley et al. | 246/63 R X |
| 4,026,506 | 5/1977 | Bourke et al. | 246/187 C X |
| 4,046,342 | 9/1977 | Buzzard | 246/187 C X |

FOREIGN PATENT DOCUMENTS 2001321 7/1971 Fed. Rep. of Germany .... 246/63 C

*Primary Examiner*—J. D. Miller
*Assistant Examiner*—Reinhard J. Eisenzopf

[57] ABSTRACT

Installation for controlling trains defining allocated cross-overs with conductor loops, in accordance with a normal program P1*n* and an interference program P2*n*. Installation characterised in that the ground equipment of each block comprises a frequency generator GF producing a normal mode frequency F1, an interference mode frequency F2 and a frequency F3 to be modulated, supplying a mode selector SM, so as to provide a frequency signal FS*n* as a function of an occupation signal OCC ($n+1$) received by the mode selector SM and correspondin g to the occupation of the following block C$n+1$, as well as a frequency signal PP*n* enabling the interference program P2*n* to be read, and the equipment fitted on board each train comprises a logical emergency-braking circuit CLF.

2 Claims, 6 Drawing Figures

Fig: 3
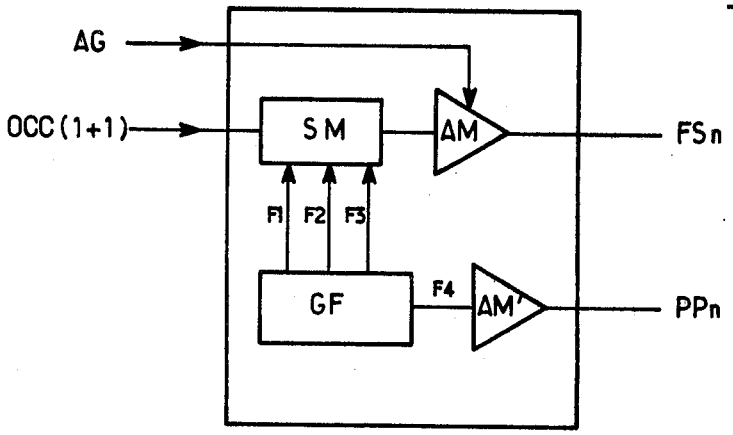
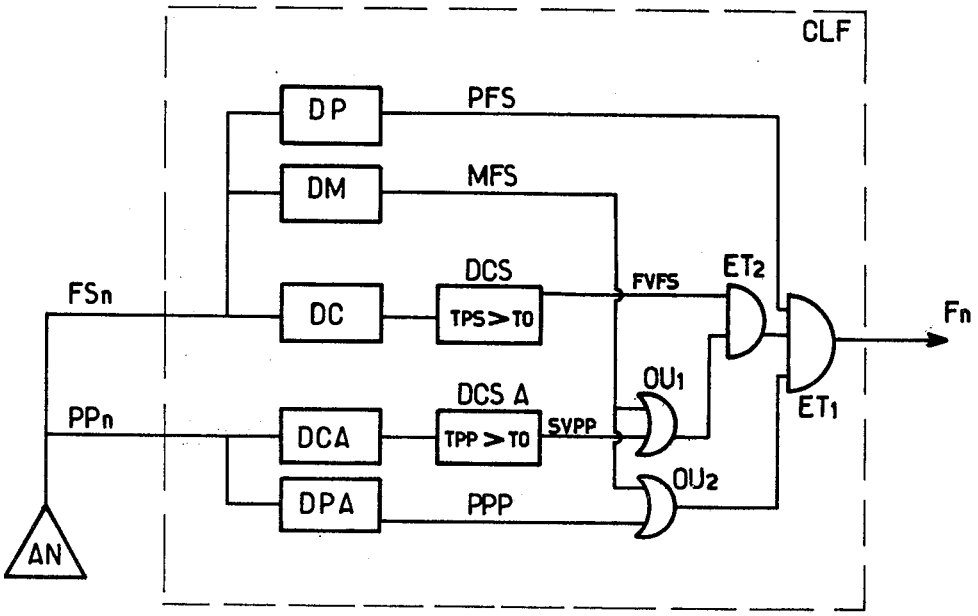
Fig: 4

DEVICE FOR CONTROLLING THE STOPPING OF A TRAIN

The present invention relates to a device for controlling the stopping of a train.

There are already known various types of devices and, more generally, installations for controlling the stopping of a train. These installations all have the aim of preventing the collision between two trains or sets of vehicles following one another on the same track.

It is already known (FIG. 1A) to divide a track L up into sections C*n* several kilometers in length, these sections being called "blocks". According to a first principle for the organisation and control of traffic on the same track L, the safety rule is applied in accordance with which two trains T1, T2 must be separated by at least one block C*n* not occupied by a train. Thus, in the event of a signal failure, a train has available at least one block C*n* for emergency braking. This first type of safety installation is termed "buffer-block safety installation".

According to FIG. 1A, the position of train T1 in the block C*n*+1 prevents the following train T2 from entering the block C*n*. Furthermore, the train T2 must at least be stationary at the end of block C*n*−1. For the train T2 this results in a stopping curve CA representing the maximum speed possible for the train T2, bearing in mind that the train T1 is occupying the block C*n*+1. In the example the stations S*i* and S*i*+1 of line L are separated by the blocks C*n*−2 . . . C*n*+2.

A second system for railway safety is known (FIG. 1B), which comprises replacing the buffer block with an intermediate block, in which the speed curve CB of the following train T2 is descending so that the speed is zero at a given distance DS before the end of the block C*n* preceding the block (C*n*+1) occupied by the train T1. This system is more flexible than the preceding one.

Finally, there exists a third method of controlling railway traffic on a track (FIG. 1C). This method of control comprises dividing up a track L into short sections L*n* . . . which are portions of conventional blocks. Each train is registered in position, starting from a reference point, and the safety speed-curve CC of the following train T2 follows the latter and moves instantaneously at the same time as the train T2. This speed curve CC is not associated with a block but with each train. The free distance DL, separating the following train T2 from the train T1 which precedes it, is equal to the stopping distance of the following train increased by a safety distance. In this third traffic system there is provided to some extent a movable and deformable block, the form of which develops with the position of the following train. In fact, by applying the forgoing principles, the free distance DL, which has to be observed by the following train T2 in relation to the train T1 preceding it, depends primarily on the relative velocity of the following train T2 in relation to the train T1 preceding it. Generally, when the two trains T1, T2 are stationary, the free distance DL is equal to the safety distance.

In the case of a system with buffer blocks, with set blocks or without buffer blocks, each train has to observe, with regard to velocity, a normal program P1 and a stopping program P2. The normal program P1 is a diagram of the maximum speed at each point of the journey and which should not be exceed by the train. This program is drawn up as a function of the geometry of the track; the halts in stations, the speeds in curves, up and down inclines etc. The maximum speeds are determined without taking into consideration the presence of other trains on the track. The stopping program P2 is drawn up to enable a train to brake over a given distance or within a given time after a signal has been produced. This program depends primarily on the characteristics of the train, such as load, braking capacity etc. The stopping program is represented by a velocity curve decreasing to zero (curves CA, CB, CC in FIGS. 1A, 1B, 1C). The stopping program has priority over the normal program.

In the first two types of installation the normal program is a fixed program associated with each block, whereas in the third system the normal program shifts with the train.

The transmission of the normal program and of the program for stopping the train is effected by means of transmission lines placed along the track. These transmission lines are generally two-wire lines which intersect at given distances so as to form cross-overs. These lines, which are also called loops, are supplied with a signal having a given frequency; the train equipped with an aerial senses the passing of line cross-overs to produce signals which are separated by intervals of time which have to be greater than a set reference value associated with each of the programs.

In fact, the normal program P1 is represented by loops B1 and the stopping program by loops B2. Since the two programs are not identical, the shape of the loops B1 and B2 is not the same, i.e. the distance separating the cross-overs of loops B1 is not the same as the distance separating the cross-overs of loops B2.

According to the prior art, one or other of the two loops B1 and B2 is supplied with a frequency signal. This alternative is of the "exclusive-OR" type, which means that one or the other and not both of the loops are simultaneously supplied with a frequency signal. The problems arising in known installations for monitoring train speed concern the transmission of data related to the clearing of the block designated n+1 which is downstream of the block designated n. By principle it is required, when the block n+1 is free, that the loop B1 of the normal program, corresponding to block n is put into use. However, when the block n+1 is occupied, the loop B2 corresponding to the stopping program is supplied.

A single aerial is provided on board each train, which aerial receives the frequency of one or other of the two loops B1 and B2 so as to detect the cross-overs of one or the other of the two loops. The electronic circuit utilising the receiving signal produces, for example, a pulse signal corresponding to each cross-over. A comparator compares the interval between these pulse signals with a rated time. This comparison makes it possible to determine whether the distance between two cross-overs has been covered by the train more rapidly or less rapidly than the set time fixed by the corresponding program. If the time required to cover the distance between two cross-overs is less than the rated time (which means that the train is travelling at a speed higher than the rated speed fixed by the program), the comparison circuit issues an excess-speed signal which controls the drive unit and/or the brakes of the train so that the speed provided for by the program is observed.

The switching from one loop to another always presents difficulties when passing from the stopping speed-curve P2 (loop B2) to the normal program speed-curve P1 (loop B1); in fact, there is interference in the detection of the cross-overs, since the distance between the cross-overs is not the same in both loops. This interference is at its highest if two successive cross-overs in the space for the two loops are arranged very close together. This interference causes the detector to detect an excessively short time corresponding to an excessively high speed and the excess-speed comparison circuit produces an alarm signal as long as the aerial has not detected two successive cross-overs of the same loop. In order to obviate this drawback, in accordance with the prior art, provision is made to inhibit the alarm signal emitted under these conditions. By means of a modulator the frequency signal supplied to the new loop is modulated at the same time as the switching operation is controlled. This modulation is detected in the operating circuit of the train so as to produce a signal suppressing the alarm signal. The duration of this modulation is selected as a function of the circuit.

The disadvantage of such an installation is that during the inhibiting period corresponding to the emission of the modulation signal, the safety braking circuit cannot take into consideration other alarms which may be imperative and, in particular, an actual excess-speed alarm. This represents an extremely serious disadvantage in known installations.

The present invention has the object of devising an installation for controlling the stopping of trains from a point of view of safety, which is not blind during a change in mode of operation, upon passing from the normal program to the stopping program.

For this purpose the invention relates to an installation of the above type, characterised in that the ground equipment associated with each block comprises a frequency generator GF which produces a normal mode frequency F1, an interference mode frequency F2 and a carrier frequency F3 to be modulated, supplying a mode selector SM connected to an amplifier AM with the frequency signal F3 modulated by the normal signal F1, or by the interference signal F2, to provide a frequency signal FS*n* as a function of an occupation signal OCC (n+1) received by the mode selector SM and corresponding to the occupation of the following block C*n*+1, as well as a frequency signal PP*n* making it possible for the interference program P2*n* to be read, and the equipment provided on board each train comprises a logical emergency-braking circuit (CLF) supplying an emergency-braking signal F*n* as a function of the signals FS*n* and PP*n* detected by its aerial AN, this logical circuit CLF detecting both the signal FS*n* and the signal PP*n* so as to actuate the priority control over the signal PP*n* defining the interference program, when this circuit detects a signal F*sn* corresponding to an interference mode.

The present invention will be described in more detail below with reference to the accompanying drawings, in which:

FIG. 3 is a block diagram of the part of the installation on the ground for controlling stopping;

FIG. 4 is a general diagram of the part of a stop-controlling installation provided on board a train.

The installation for controlling the stopping of trains in accordance with the invention comprises a ground unit and a unit fitted on board the trains.

Figures 1A, 1B, 1C:
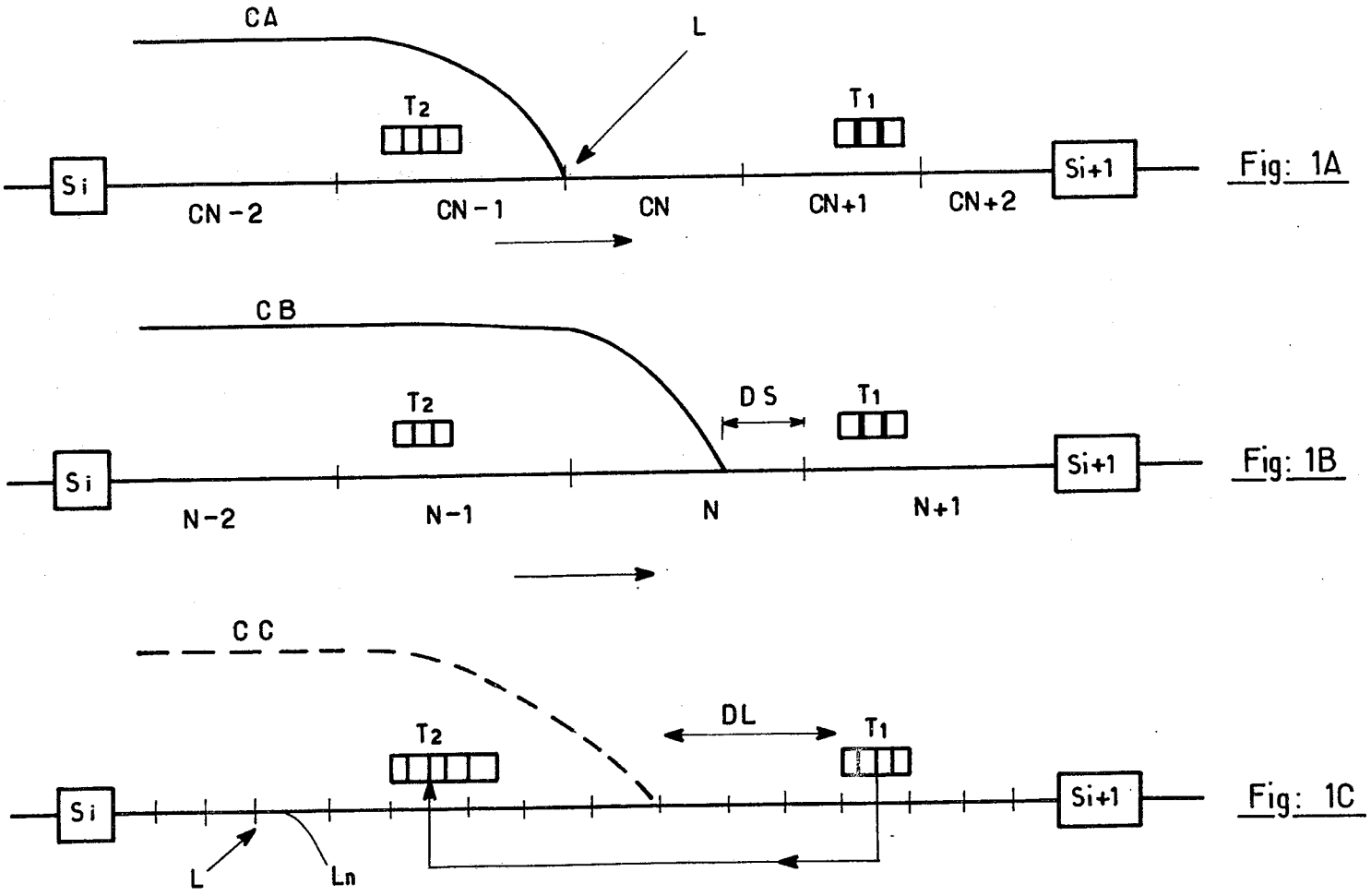
FIG. 1A is a diagram of a track divided up into blocks and of a stopping speed program associated with this track, in the case of a buffer block.
FIG. 1B is a similar diagram to that in FIG. 1A, in the case of an installation without buffer block.
FIG. 1C is a similar diagram to the preceding diagram, in the case of a speed program in a system having movable and deformable blocks.
Figure 2:
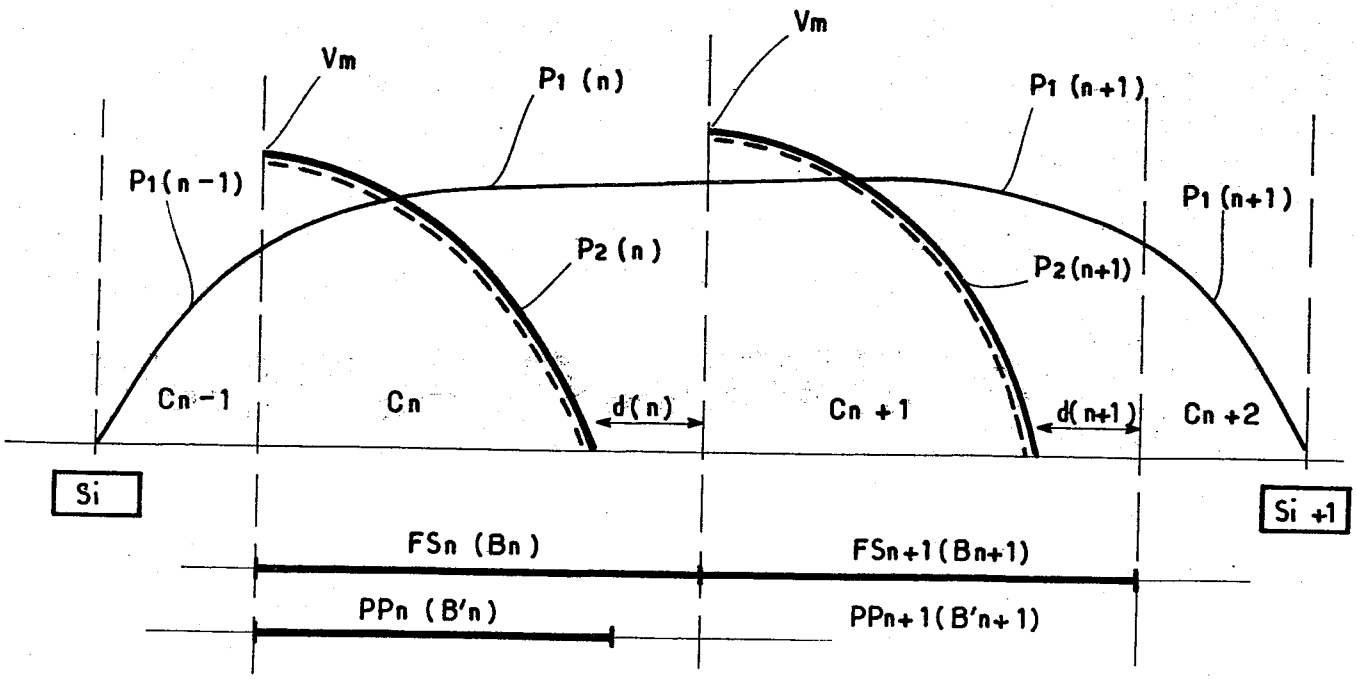
FIG. 2 is a diagram of a normal speed program and of the stopping programs of a track, in the portion separating two stations.

FIG. 2 represents an interval between two stations S*i*, S*i*+1 separated by blocks C*n*−1, C*n*, C*n*+1, C*n*+2 bearing respectively the serial numbers n−1, n, n+1, n+2 from any origin.

FIG. 2 shows, on the one hand, the curve of the normal program formed by sections P1(n−1), P1(n), P1(n+1), P1(n+2) and the stop program curves P2(n−1), P2(n), P2(n+1), P2(n+2) respectively associated with the blocks C*n*−1, C*n*, C*n*+1, C*n*+2.

The curve of the normal program starts at zero in the section P1(n−1) of block C*n*−1, then the speed increases and has a substantially constant course through the blocks C*n* and C*n*+1, then it decreases again to be reduced to zero at station S2 in the section P1 (n+1). The stopping curves P2 (n) and P2 (n+1) are curves decreasing from a maximum speed V*m* to a zero speed located at a distance d*n* and d*n*+1 before the end of the respective block C*n*, C*n*+1. Such curves likewise exist for the blocks C*n*−1 and C*n*+2, but they have not been illustrated.

FIG. 2 likewise shows the diagrammatical representation of the loops B*n*, B'*n* and B*n*+1, B'*n*+1 corresponding respectively to the lead supplying the normal-program signal P1 (n), P1 (n+1) and the stopping-program signal P2(n), P2(n+1).

FIG. 3 is a diagram of the ground equipment corresponding to an ordinary block. The term "ordinary block" designates any block not exhibiting any special characteristics.

This equipment produces a frequency signal FS*n* associated with this block C*n*. This frequency signal FS*n* supplies the transmission loop B*n* of this block C*n*. The signal FS*n* picked up at the output from the ground equipment and which supplies the loop B*n* depends on the different signals received by the equipment of block C*n*.

The frequency generator GF generates two low-frequency signals, i.e. a normal mode signal F1 and an interference mode signal F2, together with a high-frequency signal F3 intended to be modulated by one or other of the signals F1 and F2 following the operation of the mode selector SM. These three signals feed the mode selector SM, the output of which is connected to the amplifier AM which supplies the output signal FS*n*.

The mode selector SM receives an occupation signal OCC (n+1) originating from the block C*n*+1 which succeeds the block C*n* in the direction of travel of the trains. This occupation signal OCC (n+1) is a logical signal defined as follows:

the condition of signal OCC (n+1) is equal to zero, if the block C*n*+1 is occupied or if there is any other reason which necessitates the stoppage of the train in block C*n*, the condition of signal OCC (n+1) is equal to 1, if the block C*n*+1 is clear and there are no other reasons necessitating the stoppage of the train in block C*n*.

The signal FS*n* supplied by the amplifier AM is modulated by the signal F1 for signal OCC (n+1)=1 and by signal F2 for signal OCC (n+1)=0. The signal FS*n* is cut off when the amplifier AM receives a signal AG=0.

The generator GF likewise generates a frequency $F_4$ amplified by the amplifier AM' so as to give the signal PP*n* of the stop program. This signal PP*n*, which supplies the loop B'*n*, corresponds to the stop program P2*n*. This signal is not modulated. It is a question of a signal having a specified frequency. This signal PP*n* is always present and is only missing in the event of a breakdown. This signal is used to detect cross-overs in the loop B'*n* corresponding to the stop program P2*n*.

The amplifier AM likewise receives a general stop signal AG originating from the central control point (not shown). This signal has the purpose of controlling the stoppage of all the trains in a section or block. The signal AG is a logical signal, the condition of which is equal to 1 in the absence of any necessity for stopping. This signal AG is equal to zero for indicating a stop instruction.

According to FIG. 4, the equipment fitted on board a train comprises an aerial AN receiving the signals PP*n* and FS*n* which are combined by the logical emergency-braking circuit CLF emitting the emergency-braking signal F*n*.

The logical circuit CLF comprises a carrier detector DP whose input is connected to the aerial AN for receiving the signal FS*n* and whose output is connected to a logical gate ET1 (AND 1) so as to supply it with the carrier signal PF*s*.

The circuit CLF likewise comprise a modulation detector DM which receives the signal FS*n* and produces a normal mode signal MFS and an interference mode signal MPP. The output MFS of the modulation detector DM is connected to the gate OU 1 (OR 1). Finally, the circuit comprises a cross-over detector DC which receives the signal FS*n* and produces pulse signals corresponding to each cross-over. These signals, which have no reference symbol, are applied to an excess-speed monitoring device DC*s* comprising a comparator (not shown) which compares the interval TPS of two cross-over pulse signals with a limit value T*o*, in order to verify whether the period TPS is longer than the limit period T*o*. If this disparity is not verified, the excess-speed devices DCS produces an excess-speed signal FVFS which is applied to a gate ET 2 (AND 2).

The logical circuit CLF likewise comprises a cross-over detector DCA receiving the signal PP*n* so as to supply, as for the signal FS*n*, pulse signals corresponding to the different cross-overs. The time interval between two cross-overs T*pp* is compared by an excess-speed stopping device DCSA with a limit value T'O in order to check whether the time T*pp* is still greater than the time T*o*'. If this disparity is not verified, the excess-speed stopping device DCSA emits an excess-speed stop signal SVPP which supplies the gate OU 1 (OR 1) at the same time as the normal mode signal MFS.

The circuit also comprises a carrier detector DPA which receives the signal PP*n* and produces a carrier signal PPP applied to one input of a gate OU 2 (OR 2) having two inputs. The second input receives the signal MFS. The gate OU 1 (OR 1) is connected to one of the inputs of the gate ET 2 (AND 2) whose other input receives the signal SVFS.

The output of the gate ET 2 (AND 2) is connected to one input of the gate ET 1 with four inputs, another input receiving the signal PFS, the third receiving the output signal (no reference) of the gate OU 2 and the fourth one receiving the output signal of the gate OU 3.

The gate OU 3 receives at its inputs the signals MFS and MPP so that the emergency braking is controlled by the gate ET 1 (AND 1), in the absence of modulation of the signal FS*n*.

The combination of the signals in the circuit CLF is such that when the signal FS*n* is modulated by the interference mode signal F2 the circuit CLF is switched by logical combination to take into account the signal PP*n* and to verify in the detector DCSA whether the speed of the train is below the rated speed corresponding to the stopping program associated with the block C*n* for emitting the signal F*n*.

It is to be noted that as the layout of the loops B*n* and B'*n* is carried out as a function of a given program which correspond, in particular, to the nature of the track, this program is defined in a fixed manner by the cross-over of loops B*n* and B'*n*. The distance between the different cross-overs of the loops B*n* and B'*n* is variable as a function of the normal speed program P1*n* and of the stopping speed program P*n*. As a result of this mode of control the logical circuit for emergency braking CLF is considerably simplified, since the normal excess-speed and stopping excess-speed devices carry out a comparison between the time taken by the trains to cover the distance between two cross-overs of the loop B*n* and B'*n* so as to compare this time with a rated value T*o* or T'*o*. These two values T*o* and T'*o*, which, if necessary, may or may not be identical, are constants. These constants are associated with each train. These constants may be the same for all trains but it is also possible for them to be different. Generally, the logical braking circuit described above operates in the following manner:

The signal FS*n* designated as signal FS below for the purpose of simplification, without the index n which corresponds to the transmitter blocks, is used for the detection of cross-overs, modulation detection and carrier detection.

The detection of cross-overs achieved by the signal FS gives an instruction to the excess-speed device, according to which the actual travel time T*ps* taken by the trains to cover the distance between two cross-overs is higher or lower than a reference value T*o*. The excess-speed device produces a logical signal FVFS, the condition of which is equal to 0 if the device detects an excess speed (i.e. the travel time TFS is less than the rated time T*o*). Conversely, i.e. if the operation is normal and there is no excessive speed (time TPS greater than T*o*), the condition of signal FVFS is equal to 1.

Similarly, the signal FS undergoes a modulation detection. If the signal FS is modulated in normal mode, this means that the next block is clear. This modulation data is used to inhibit the excess-speed actuation associated with the interference program, so that the excess-speed curve P2 cannot influence the operation of the train.

Finally, the signal FS undergoes a carrier detection. In the absence of a carrier, the signal PFS is in the zero condition, which is shown by a logical, zero condition signal F*n* controlling the emergency-brake stop.

The signal PP of the interference program P2 is used to detect the cross-overs of the loop B'*n* which forms the speed curve P2 of the interference program so as to verify whether there is excess speed. Similarly, this signal undergoes a carrier detection so as control, in the absence of a carrier, the signal PPP which causes the emission of the signal F*n* controlling the emergency braking, if the modulation signal MFS is equal to 0.

The various signals supplied by the components of the logical-emergency braking circuit CLF are signals which may exist in parallel and which are not time-dependent. It is not a question of sequential signals and only the combination of these signals defines the condition of signal F*n*.

In general, the control of the emergency braking by the signal F*n* is effected in the following conditions:

(1) PFS=0: the signal PFS of the carrier detector is equal to the zero condition, by itself.

(2) FVFS=0: the signal SVFS is equal to the zero condition, by itself.

(3) SVPP=0 and MFS=0: the signal SVPP=0 and, simultaneously, the signal MFS is equal to 0; this corresponding to the absence of normal mode. Conversely, the normal mode inhibits the action of SVPP=0.

(4) PPP=0 and MFS=0: this corresponds to the control of the emergency brake in the zone between the end of the curve B'*n* of the interference program P*n* and the end of block n. If the following block C*n*+1 is occupied, the signal OCC (n+1) is equal to zero.

Additionally, it should be noted that any failure simulates an occupation of a block with a restrictive instruction OCC (n+1)=0.

I claim:

1. Installation for controlling the stopping of trains with ground equipment and equipment fitted on board each train, the ground equipment comprising conductor loops which define cross-overs, these cross-overs being allocated on the one hand, according to a normal program P1*n* and, on the other hand, according to an interference program P2*n* associated with each block C*n* of the series n, each loop being traversed by a signal FS*n*, PP*n* formed by the ground equipment, said installation being characterised in that the ground equipment associated with each block comprises a frequency generator GF generating a normal mode frequency F1, an interference mode frequency F2 and a carrier frequency F3 to be modulated, supplying a mode selector SM, which is connected to an amplifier AM, with a frequency signal F3 modulated by a normal signal F1, or by an interference signal F2, so as to provide a frequency signal FS*n* as a function of an occupation signal OCC (n+1) received by the mode selector SM and corresponding to the occupation of the following block C*n*+1, as well as a frequency signal PP*n* enabling the interference program P2*n* to be read, and the equipment fitted on board each train comprises a logical emergency-braking circuit CLF supplying an emergency-braking signal F*n*, as a function of the signals FS*n* and PP*n* detected by its aerial AN, this logical circuit CLF detecting both the signal FS*n* and signal PP*n* for actuating the priority control over the signal PP*n* defining the interference program when this circuit detects a signal FS*n* corresponding to the interference mode.

2. Installation according to claim 1, characterised in that the emergency-braking circuit comprises a carrier detector DP receiving the normal frequency signal FS*n*, so as to produce a carrier signal PFS, a modulation detector DM receiving the signal FS so as to produce a normal mode signal MFS and an interference mode signal MPP, and a cross-over detector DC supplying an excess-speed device DCS which produces a logical excess-speed signal FVFS, and a carrier detector DPA receiving the signal PP*n* for producing a carrier signal PPP and a cross-over detector DCA, likewise receiving the signal PP*n*, for supplying an interference program excess speed device DCSA and producing an interference program excess-speed signal SVPP which is combined with the carrier signal PPP and also with signals revealing the interference condition in the signal FSN so as to produce the emergency stop signal F*n*.

* * * * *